United States Patent [19]

Nelson

[11] 4,006,535

[45] Feb. 8, 1977

[54] APPARATUS AND METHOD FOR CONTROLLING CYCLES OF OPERATION OF A DRYER

[75] Inventor: James K. Nelson, Marion, Ill.

[73] Assignee: Fedders Corporation, Edison, N.J.

[22] Filed: Nov. 5, 1975

[21] Appl. No.: 628,922

[52] U.S. Cl. ..... 34/55; 34/133

[51] Int. Cl.[2] ..... F26B 11/04

[58] Field of Search ..... 34/52, 53, 55, 133; 74/527, 553; 192/95; 200/38 A, 38 B, 38 CA, 61.79, 61, 62, 330

[56] References Cited

UNITED STATES PATENTS

| | | | |
|---|---|---|---|
| 2,813,354 | 11/1957 | Buck | 34/133 |
| 2,978,232 | 4/1961 | Kruzan | 34/133 |
| 3,325,908 | 6/1967 | Gartley | 34/48 |
| 3,483,632 | 12/1969 | Triplett | 34/133 |

*Primary Examiner*—John J. Camby
*Assistant Examiner*—Larry I. Schwartz
*Attorney, Agent, or Firm*—McAulay, Fields, Fisher & Goldstein

[57] ABSTRACT

The dryer apparatus includes a cabinet that rotatably supports a drum therein. A door on the cabinet is operable between an open position to permit access to the drum and a closed position. A motor is provided for rotating the drum and cycle changing apparatus is provided for changing the cycle of operation of the dryer between a normal tumble dry operation and a static dry operation. Included is control means for operating the cycle changing apparatus and for simultaneously deenergizing the motor as the dryer is switched from one cycle of operation to another cycle of operation. The control means comprises a switch movable to a closed state in response to movement of the door to the closed position to connect the motor with a source of energy. The control means further includes an actuating shaft and an operating lever on the actuating shaft that is connected to the cycle changing apparatus for effecting the change in cycle of operation of the dryer as the shaft is moved from a first to a second position. A mounting bracket mounts the shaft adjacent the door so that the shaft is accessible only when the door is in the open position whereby movement of the door to the open position permits access to the actuating shaft and causes movement of the switch to an open position to simultaneously deenergize the motor.

A novel method of operation similarly is disclosed.

8 Claims, 6 Drawing Figures

APPARATUS AND METHOD FOR CONTROLLING CYCLES OF OPERATION OF A DRYER

The present invention relates to a method and an apparatus that provides a clothes dryer or the like that may be safely switched between different cycles of operation and, more particularly, pertains to a method and an apparatus for a dryer that eliminates undue stress and strain on the mechanical portions of the dryer as the dryer is switched between cycles of operation.

One type of home clothes dryers is provided with different cycles of operation to increase the versatility and use of such dryer. For example, in addition to the normal tumble dry cycle of operation of such dryer, the dryer is provided with a so-called static dry cycle of operation such as shown in U.S. Pat. Nos. 2,813,354; 2,978,232; and 3,483,632, all of which are assigned to the assignee of the present invention. To be more specific, home dryers normally include a rotatable drum within a cabinet. During a normal tumble dry operation, the drum is caused to rotate by a motor as hot air is drawn through the drum thereby drying the clothes within the drum. On the other hand, in a static dry cycle of operation, the drum is stationary while the hot air is caused to traverse the drum. In both cycles of operation, the hot air is made to flow through the drum by a fan. In order to produce an economical dryer, the same motor that causes rotation of the drum also drives the fan. In practice, it has been found that there are problems associated with dryers having the aforementioned type of construction.

To be more specific, the cycle changing apparatus that affects switching between the normal tumble dry cycle and the static dry cycle is a device that is, in some cases, separate and apart from the circuitry that controls operation of the motor. Moreover, the motor must be energized regardless of the cycle of operation of the dryer because the fan must be operated whether the dryer is performing a tumble dry operation or a static dry operation. However, because of the construction of the controls, if the motor remains energized during the time that the dryer is switched from one cycle of operation to another cycle of operation, the dryer may not switch to the static dry cycle. Moreover, in a purely mechanical system, a severe strain will be put on the drum driving belt and the other mechanical portions of the dryer. Thus, the sudden removal or application of load to the motor may result in breakage of the aforementioned parts or their early failure.

Accordingly, an object of the present invention is to provide improved cycle control apparatus for a dryer.

A more specific object of the present invention is to provide dryer cycle control apparatus that is reliable and efficient in operation.

Another object of the present invention resides in the novel details of construction that provide a cycle control apparatus in a dryer that is effective to automatically deenergize the dryer motor as the dryer is switched from one cycle of operation to another cycle of operation.

Accordingly, a dryer constructed according to the present invention comprises a cabinet having a rotatable drum therein. A door on the cabinet is operable between an open position to permit access to the drum and a closed position and motor means is provided which rotates the drum. The dryer includes cycle changing means which change the cycle of operation of the dryer between first and second cycles. Control means is provided for operating the cycle changing means and for deenergizing the motor as the dryer is switched from one to another cycle of operation. The control means comprises a switch normally residing in an open state and movable to a closed state in response to movement of the door to the closed position to connect the motor means in circuit with the source of energy. The control means further comprises an actuating shaft and operating means on the actuating shaft that is connected to the cycle changing means for changing the cycle of operation of the dryer between said first and second cycles in response to movement of the shaft between first and second positions. Mounting means mounts the shaft adjacent the door so the shaft is accessible only when the door is in the open position, whereby movement of the door to the open position permits access to the actuating shaft and causes movement of the switch to the open position to simultaneously deenergize the motor means. By locating the shaft so it is accessible only upon opening the door, the need for a separate switch to deenergize the motor is eliminated. That is, the door interlock switch functions to deenergize the motor means both to prevent injury to the user and also to permit cycle switching.

A further object of the invention is to provide a method for controlling operation of a dryer between different cycles wherein the dryer motor is reliably disabled during such switching step.

Other features and advantages of the present invention will become more apparent from a consideration of the following detailed description when taken in conjunction with the accompanying drawing, in which.

As noted above, the dryer of the present invention is adapted to perform a first or normal tumble dry cycle of operation and a second or static dry cycle of operation. In the normal tumble dry operation, the dryer drum is rotating whereas in the static dry cycle of operation, the drum is stationary. In order to eliminate undue stress and strain on the moving parts of the system, it is highly desirable that the dryer motor be deenergized during switching from one cycle of operation to another cycle of operation. One such apparatus for accomplishing this result is disclosed in application Ser. No. 571,241 entitled CONTROL DEVICE FOR STOP-AND-DRY FEATURE, filed on Apr. 24, 1975 now U.S. Pat. No. 3,973,330, and assigned to the assignee of the present invention. The aforementioned application discloses a control device that is accessible from the exterior of the machine. On the other hand, the present invention comprises an apparatus that is accessible only through the open door of the dryer.

Figure 1:
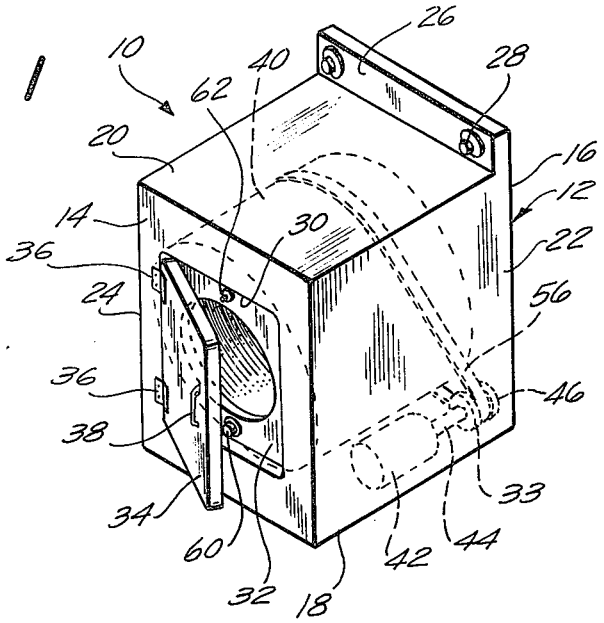
FIG. 1 is a perspective view of a dryer having cycle control apparatus therein constructed according to the present invention.

More specifically, a dryer having control apparatus constructed according to the present invention is designated generally by the reference numeral 10 in FIG. 1 and comprises a cabinet 12 having a front wall 14, a rear wall 16, a bottom wall 18, a top wall 20 and opposed side walls 22 and 24. Upstanding from the top wall 20 is a control panel 26 having dryer controls thereon such as a timer control 28. Provided in the front wall of the dryer is an opening 30 that is surrounded by a recessed lip 32. A front door 34 is sized to fit within the recess and is coextensive therewith and is hingedly mounted on the front wall 14 by respective hinges 36. The door 34 is adapted to be moved between an open position to permit access to the interior of the cabinet through the opening 30 and a closed position wherein the door closes the opening 30. A conventional snap lock (not shown) may be provided on the door which is engageable with an edge of the opening 30 to retain the door in the closed position. A handle 38 mounted on the door 34 facilitates unlocking of the door by pulling outwardly on the handle. As noted in greater detail below, when the door is in the closed position, the outer surface thereof is coplanar with the remainder of the front wall 14 to present a smooth, flat appearance.

Figure 6:
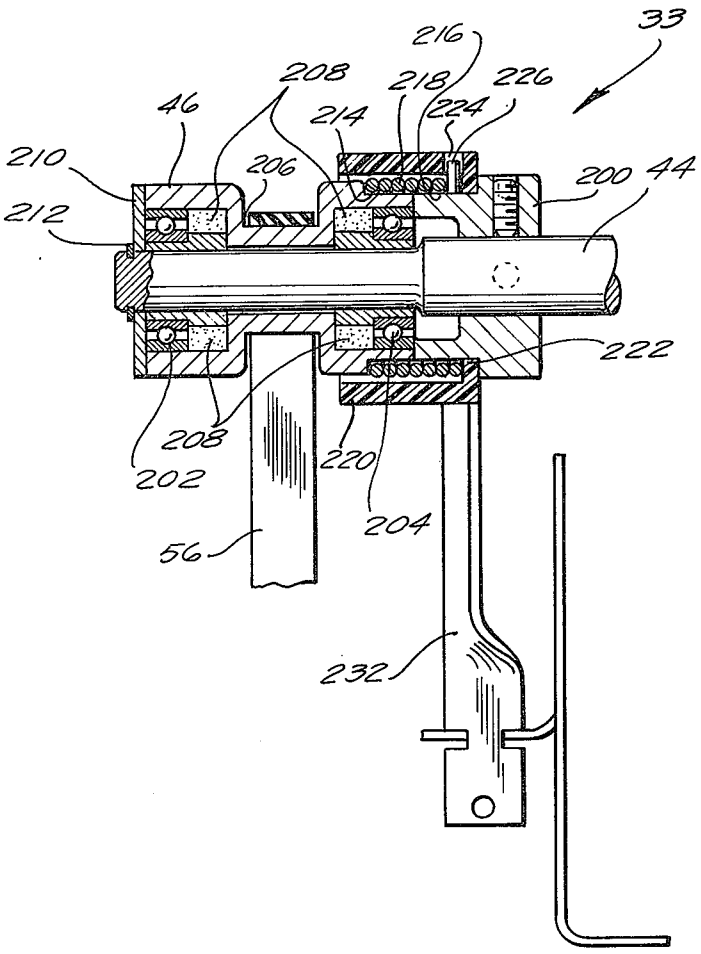
FIG. 6 is a vertical sectional view of the clutch mechanism.

Rotatably received within the cabinet 12 is a drum 40 having a front opening that is accessible through the opening 30 in the front wall 14 of the cabinet. The drum is conventional in construction and is adapted to receive clothes or other materials therein to be dried. Hot air is made to flow through the drum thereby to dry the materials therein. Rotation of the drum is controlled by a motor 42 located within the cabinet. The motor comprises an output shaft 44 that drives a pulley 46 through a clutch mechanism 33. A drive belt 56 surrounds the drum 40 and the pulley 46 so that rotation of the pulley 46 by the drive or output shaft 44 through the clutch mechanism 33 causes concomitant rotation of the drum 40. More specifically, the clutch mechanism 33 comprises a clutch hub 200 (FIG. 6) that is secured to the shaft 44 by a set screw (not shown) or the like so that the hub rotates with the shaft. Spaced ball bearings 202 and 204 are also received on the shaft 44 and rotatably support the cylinder drive pulley 46. The pulley 46 is provided with a reduced diameter center portion 206 that is drivingly connected with the belt 56. Oil soaked felt rings 208 are received between the respective bearings 202 and 204 and the enlarged diameter portions of the pulley 46 and serve as reserve lubrication for the ball bearings. The pulley is retained in place on the shaft 44 by a thrust washer 210 and a retaining ring 212.

Pulley 46 and clutch hub 200 are provided with aligned adjacent reduced diameter portions 214 and 216, respectively. Surrounding portions 214 and 216 is a clutch spring 218 that has an interference fit on the clutch hub 200 and the pulley 46. Rotatably received on the hub 200 and surrounding the spring 218 is an actuating shield 220 having a reduced diameter portion 222 that rides on the hub. The shield 220 includes a radially extending slot 224 that receives an upstanding tab 226 at one end of the spring 218.

Figure 5:
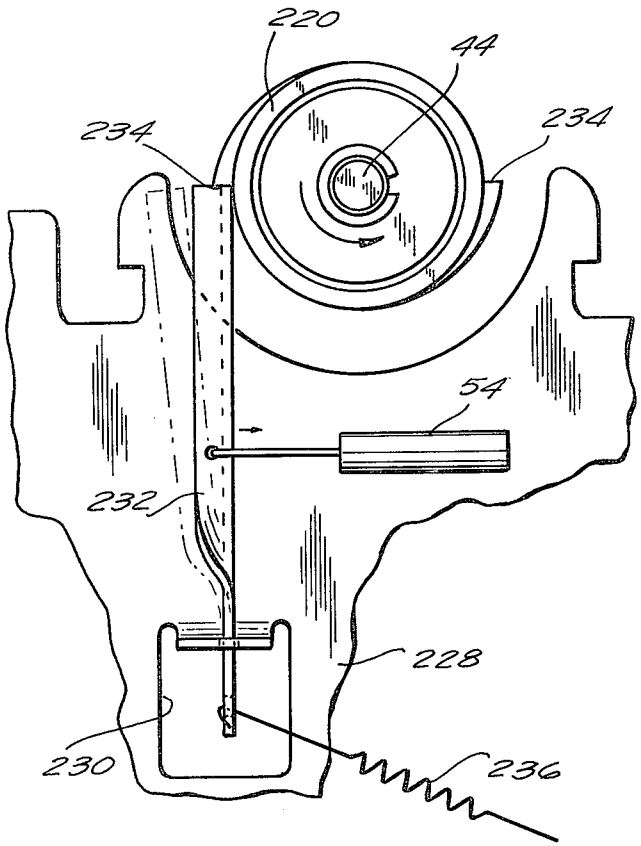
FIG. 5 is a front elevational view of a clutch mechanism that may be used in conjunction with the apparatus of the present invention.

Received on the motor mounting bracket 228 (FIG. 5) is a lever support bracket 230 that pivotally supports a clutch actuating lever 232. The shield 220 is provided with diametrically opposed radially extending latching tabs 234 that are adapted to be engaged by the lever 232 as shown by the solid line position of the lever in FIG. 5. However, the lever 232 is normally biased to the dotted line position shown in FIG. 5 by a spring 236 having one end connected to the lower end of the lever and the other end anchored to the bracket, for example. A Bowden cable 54 is connected to the lever 232 to permit control of the lever 232 by the apparatus, as noted below.

Under normal circumstances, when the dryer is performing a normal tumble dry operation, the lever 232 is out of contact with the shield 220. Accordingly, the pulley 46 is driven by the clutch hub 200 via the clutch spring 218. However, when it is desired to cause the dryer to perform a static dry cycle, the Bowden cable 54 is operated to bring the lever 232 to the full line position shown in FIG. 5. As the shield 220 rotates (by means of the tab 226 and slot 224) one of the latching tabs 234 will engage the lever 232 to arrest further rotation of the shield. This action prevents further rotation of the spring 218 via the tab 226 on the end coil of the spring. The direction of rotation of the hub is such that the spring unwraps from the hub thereby permitting the hub and motor shaft to rotate without rotating the pulley 46.

Accordingly, this clutch arrangement may be considered to be cycle changing apparatus that permits the dryer to be switched between a first or static dry cycle when the pulley is not driven by the shaft 44 and a second or normal tumble dry cycle when the pulley is in driving contact with the shaft, thereby causing the drum 40 to rotate. It should be noted, however, that this cycle changing apparatus is for illustrative purposes only and is not to be interpreted as being a limitation of the present invention. That is, any construction that selectively connects and disconnects the motor with the drive belt may be utilized.

As noted above, the foregoing cycle changing apparatus is particularly important in dryers that incorporate a so-called static dry feature. To be more specific, the drive motor 42 in the dryer is normally used to operate a number of mechanical elements within the dryer in addition to causing the drum 40 to rotate. For example, the motor is normally connected to a fan (not shown) within the dryer that causes the circulation of the hot air through the dryer drum. During a normal tumble dry operation, the motor 42 causes rotation of the drum via drive belt 56 and also drives the fan to cause the hot air to move through the drum. However, during a static dry cycle of operation, the drum 40 is stationary. The fan must continue to operate in order to cause the air to flow through the drum. Hence, the arrangement that includes the clutch mechanism 33 permits operation of the motor 42 without the concomitant rotation of the drum 40.

Figure 2:
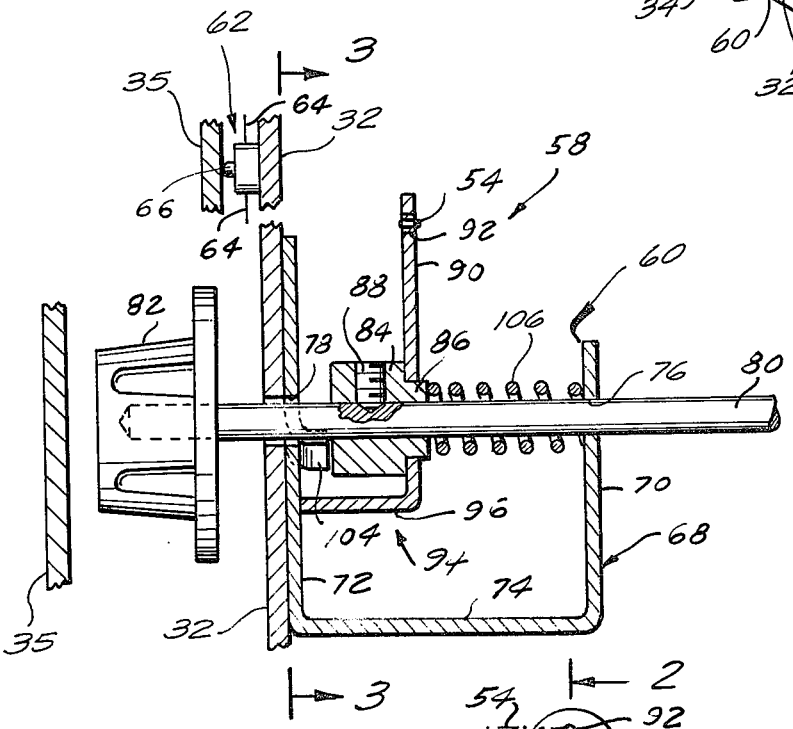
FIG. 2 is a sectional view of the control apparatus taken along the line 2—2 of FIG. 3.

A problem is presented, however, when it is desired to switch from one cycle of operation to the other cycle of operation of the dryer. That is, if the switch-over occurs during the time that the motor 42 is energized a severe strain is placed on the driving belt 56 as well as on the other portions of the dryer that are driven by the motor 42. Accordingly, a control apparatus designated generally by the reference numeral 58 in FIG. 2 is provided and comprises a cycle changing device 60 and a motor deenergizing switch 62 both of which are mounted on the lip 32 of the front wall 14 and which are inaccessible when the door 34 is in the closed position. That is, the switch 62 is mounted on the upper portion of the lip 32 by conventional means (not shown) and is connected in series between a source of energy and the motor 42 by leads 64. The switch is operable between a normally open state and a closed state to connect the motor 42 in circuit with the source of energy.

The switch 62 is conventional in construction and includes a pushbutton 66 that is normally biased outwardly by a spring (not shown) or the like received within the body of the switch to normally bias the switch to the open state. The button 66 is positioned to be engaged and depressed or pushed inwardly by the door 34 when the door is moved to the closed position thereby to operate the switch to the closed position and to connect the motor 42 with the source of energy.

The cycle changing device is mounted on the lower portion of the lip 32 by mounting means in the from of a bracket 68. The bracket 68 is substantially U-shaped in profile and includes opposed legs or plates 70 and 72 connected by a bight portion 74. The leg 72 abuts the inner surface of the lip portion 32 and is affixed thereto by any conventional means such as spot welding or by bolts and nuts. Rotatably received through apertures 76 and 78 in the respective legs 70 and 72 is an actuating shaft 80. The front end of the actuating shaft 80 extends through an appropriate aperture in the lip portion 32 of the front wall 14 and fixedly receives a knob 82 thereon. As will be noted in greater detail hereinbelow, the shaft 80 is rotatable between first and second positions and is also movable from the normal position shown in FIG. 2 to a depressed position wherein the actuating shaft is moved rearwardly or toward the right as taken in FIG. 2. Appropriate C-shaped clamping washers (not shown) may be affixed to the shaft 80 to limit the rearward and forward travel of the shaft.

Supported on the shaft 80 is a support block 84 having a rearwardly extending rectangular projection 86. The support block 84 is affixed in place on the shaft by a set screw 88. Affixed to the support block 84 is a control lever 90 having an opening shaped complimentary to the rectangular projection 86 and receiving the projection 86 therein by a press fit or the like. The lever 90 extends radially outwardly from the shaft 80 and is provided with an aperture 92 that receives the other end of the Bowden cable 54 therein. Thus, rotation of the shaft 80 causes concomitant rotation of the control lever 90 and thereby causes the clutch mechanism 33 to selectively connect the disconnect the motor shaft 44 with the pulley 46. As a result, rotation of the shaft 80 will cause the dryer to execute either the normal tumble dry cycle of operation or the static dry cycle of operation.

Figure 3:
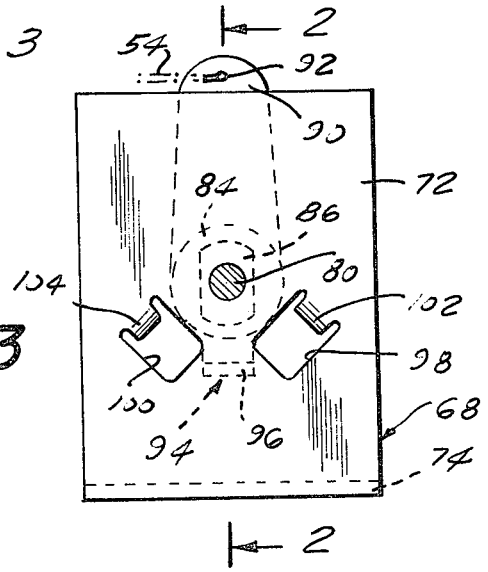
FIG. 3 is a front elevational view taken along the line 3—3 of FIG. 2.

The control lever 90 is indexed between positions corresponding to the normal or the static dry cycle of operation of the dryer by a lock device designated generally by the reference character 94. More specifically, the lock device 94 comprises a projection extending forwardly or toward the left as taken in FIG. 2 which is located at the end of the control lever 90 and is integral therewith. However, it should be noted that the projection need not be made part of the lever 90, the important consideration being that the projection is affixed to the shaft 80. The projection 96 is adapted to be received in angularly spaced openings 98 and 100 on the leg 72 of the bracket 68. The opening 98 is positioned so that when the projection 96 is received therein, the lever 90 will be oriented such that the Bowden cable 54 will control the pulley 46 to cause the dryer to execute a normal tumble dry or first cycle of operation. On the other hand, the opening 100 is position so that when the projection 96 is received therein, the lever 90 will have been rotated clockwise, as taken in FIG. 3, and will have disconnected the pulley 46 from the output shaft 44 via the wire 54 so that the dryer will now execute a static dry or second cycle of operation. Fingers 102 extend rearwardly from the rear walls of the respective openings 98 and 100 and are adapted to engage the projection 96 to limit further rotation of the shaft 80. Additionally, the fingers serve to align the projection with the associated slot when the finger engages the projection.

A spring 106 is positioned on the shaft 80 and has one end that abuts the leg 70 and another end that abuts the support block 84 and urges the projection 96 forwardly into one of the openings 98 or 100. Since the support block 84 is affixed to the shaft 80 via the set screw 88, the shaft 80 will likewise be urged forwardly or toward the left as taken in FIG. 2.

The lip or flange 32 may be provided with openings that are aligned with the respective openings 98 and 100 so that the projection 96 may extend therethrough. When the projection is received in one of the openings, the shaft 80 will be prevented from executing any rotational movement. Additionally, the projection 96 is sized so that when the shaft 80 is moved rearwardly against the bias of the spring 106, the projection 96 may be moved out of the associated opening so that the shaft can now be rotated. Accordingly, the lock device 94 provides a positive lock to maintain the clutch mechanism in the selected state regardless of vibration of the dryer.

Figure 4:
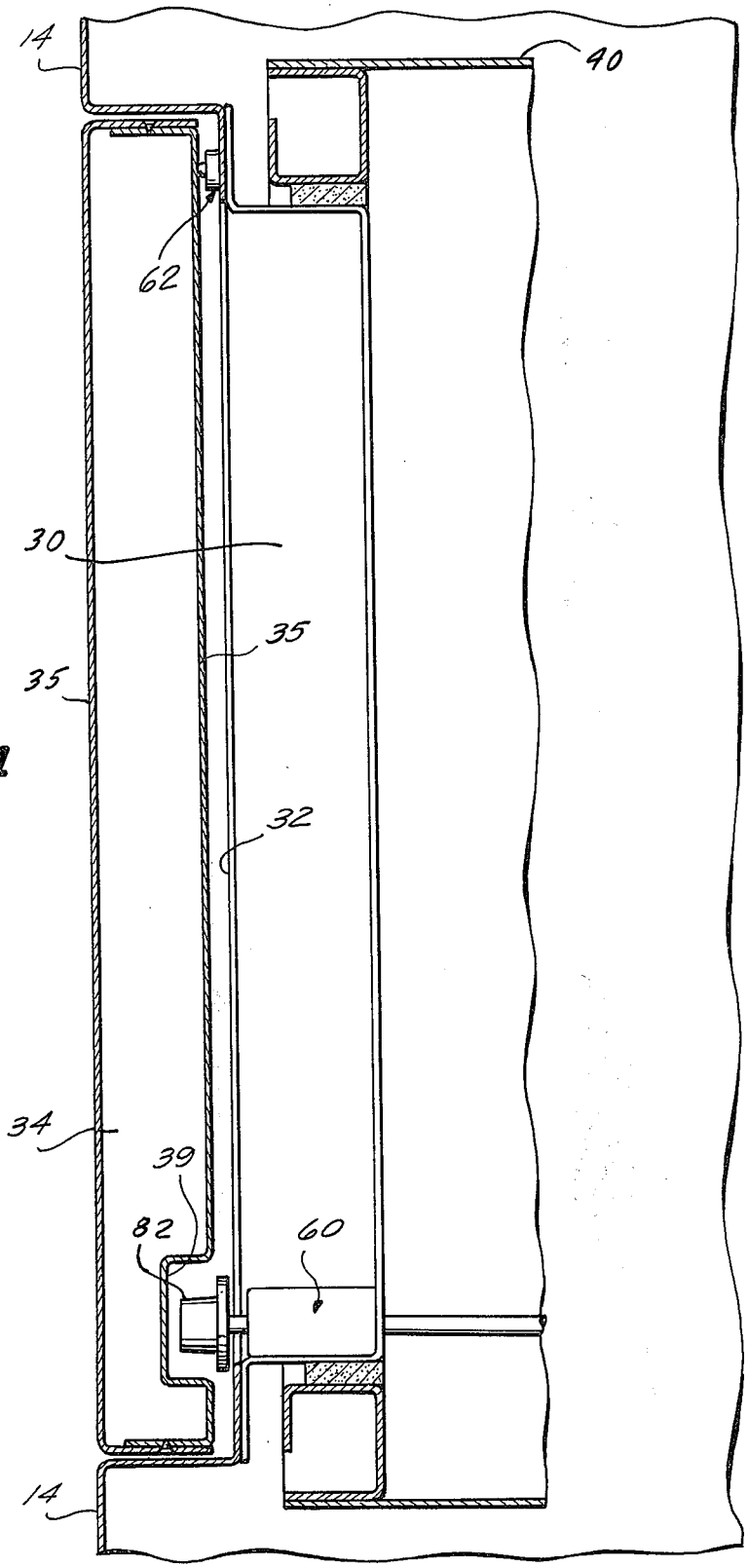
FIG. 4 is a detail sectional view of the door of the dryer shown in FIG. 1 and related elements when the door is in the closed position.

It is to be noted that the knob 82 projects beyond the pushbutton 66 of the switch 62. Since the cycle changing device 60 and switch 62 are in facing and underlying relationship to the door 34 when the door is in the closed position and in order to accommodate the greater extension of the knob 82 and still maintain the door 34 coplanar with the remainder of the wall 14, the rear portion of the door is recessed. That is, as shown in FIG. 4, the door 34 comprises an outer panel 35 and an inner panel 37 connected together along peripheral flanges at the edges of the respective panels. The inner panel acts as a heat baffle to prevent the outer panel from getting too hot. The inner panel is recessed at 39 to provide clearance for the knob 82.

In operation, and for purposes of illustration it is assumed that the dryer is executing a normal tumble dry or first cycle of operation. Accordingly, the control lever 90 will be oriented such that the projection 96 will be received in the opening 98 and door 34 of the dryer will be closed. When it is desired to cause the dryer 10 to perform a static dry or second cycle of operation, the door 34 is opened. Accordingly, the pushbutton 66 will extend outwardly and the switch will automatically move to the open state thereby deenergizing the motor 42. The knob 82 may then be grasped and pushed inwardly to depress the shaft 80 until the projection 96 is spaced from or clears the opening 98. The shaft 80 is then rotated clockwise until the projection 96 engages the finger 104.

At this point, the knob 82 may be released and the spring 106 will urge the shaft 80 forwardly so that the projection 96 extends through the opening 100. The lever 90 will now be in the orientation such that the pulley 46 will have been disengaged from the shaft 44 so that the dryer will now perform a static dry cycle of operation. The door is now closed to depress the pushbutton 66 thereby connecting the motor with its source of energy so that the mechanical elements within the dryer other than the drum may be operated by the motor.

When it is desired to again switch cycles of operation of the dryer, the door 34 is again opened so that access may be had to the knob 82 of the cycle changing device 60. This will automatically cause the switch 62 to deenergize the motor. The cycle changing device 60 may be rotated in the reverse direction, after releasing the lock device to change cycles back to the tumble dry cycle.

Accordingly, an apparatus and method have been described which permit the safe and reliable changing of cycles of operation of a dryer without resultant harm to any of the motor operated elements within the dryer. Additionally, the present invention eliminates the need for an additional switch to deenergize the motor and its attendant expense. That is, if the cycle changing device were located elsewhere, an additional switch would be required to deenergize the motor before the device could be operated to change cycles. However, by positioning the cycle changing device behind the door, the single door interlock switch performs the dual function of deenergizing the motor both for preventing injury to the operator and also to permit changing of cycles.

While a preferred embodiment of the invention has been shown and described herein, it will become obvious that numerous omissions, changes and additions may be made in such embodiment without departing from the spirit and scope of the present invention.

What is claimed is:

1. A dryer comprising a cabinet; a rotatable drum within said cabinet; a door on said cabinet operable between an open position to permit access to said drum and a closed position; motor means for rotating said drum; cycle changing means for changing the cycle of operation of said dryer between first and second cycles; and control means for operating said cycle changing means and for deenergizing said motor as said dryer is switched from one to another cycle of operation, said control means comprising a switch normally residing in an open state and movable to a closed state in response to movement of said door to the closed position to connect said motor means in circuit with a source of energy, an actuating shaft, operating means on said actuating shaft connected to said cycle changing means for changing the cycle of operation of said dryer between said first and said second cycles in response to movement of said shaft between first and second positions, and mounting means for mounting said shaft adjacent said door so that said shaft is accessible only when said door is in the open position, whereby movement of said door to said open position permits access to said actuating shaft and causes movement of said switch to said open position to simultaneously deenergize said motor means.

2. A dryer as in claim 1, and a recess on said dryer mounting said switch and said shaft thereon and positioned to be in facing and underlying relationship to said door when said door is in the closed position, said switch comprising a pushbutton engageable by said door when said door is moved to the closed position to move said switch to said closed state.

3. A dryer as in claim 1, and lock means connected to said shaft for preventing movement of said shaft between said first and second positions until the shaft has been moved from a third to a fourth position.

4. A dryer as in claim 3, in which said shaft is mounted for rotation between said first and second positions and for linear movement between said third and fourth positions, said lock means comprising a projection connected to said shaft, and a plate in facing relationship to said projection and having angularly spaced openings therein that are respectively aligned with said projection when said shaft is in said first and second positions, said projection being sized to be received in one of said openings when said shaft is in said third position and is spaced therefrom when said shaft is in said fourth position, whereby said shaft may be rotated between said first and second positions when said shaft is in said fourth position.

5. A dryer as in claim 4, and a spring normally biasing said shaft to said third position.

6. A dryer as in claim 5, and a pair of fingers on said plate projecting out of the plane thereof and positioned to engage said projection when said shaft is in said first or second position to prevent rotation of said shaft therebeyond.

7. A method for changing the cycle of operation of a dryer from a first to a second cycle wherein the dryer is of the type having a cabinet having an opening therein, a drum within the cabinet rotatable by a motor, and a door on the cabinet operable between an open position to permit access to said drum through said opening and a closed position to close said opening; said method comprising mounting a motor control switch and cycle control apparatus adjacent said opening with said switch engageable by said door to connect the motor with a source of energy when the door is in the closed position and to disconnect the motor therefrom when the door is in the open position, opening said door to actuate said switch to disconnect said motor from said source of energy, operating said cycle control apparatus to change the cycle of operation of said dryer, and closing said door to actuate said switch to connect said motor with said source of energy, said mounting step comprising mounting said switch and said cycle control apparatus in a recess of said cabinet surrounding said opening and positioning said switch and said cycle control apparatus to be covered by said door when said door is in the closed position.

8. A dryer as in claim 2, in which said door is provided with a rear panel positioned to engage and to depress said pushbutton when said door is moved to the closed position, and a recess in said rear panel sized to receive said shaft therein when said door is in said closed position.

* * * * *